US005791477A

United States Patent [19]

Batsford

[11] Patent Number: 5,791,477

[45] **Date of Patent: *Aug. 11, 1998**

[54] PACKAGING COMPONENTS

[75] Inventor: Charles A. Batsford, Stow, Mass.

[73] Assignee: Air-Ride Packaging of America, Inc., Stow, Mass.

[ * ] Notice: The term of this patent shall not extend beyond the expiration date of Pat. No. 5,570,788.

[21] Appl. No.: 745,456

[22] Filed: Oct. 25, 1996

Related U.S. Application Data

[63] Continuation of Ser. No. 367,093, Dec. 30, 1994, Pat. No. 5,570,788.

[51] Int. Cl.[6] ..... B65D 81/02

[52] U.S. Cl. ..... 206/522; 206/583

[58] Field of Search ..... 206/522, 583, 206/588, 590, 591, 592; 383/3

[56] References Cited

U.S. PATENT DOCUMENTS

| | | | |
|---|---|---|---|
| D. 212,510 | 10/1968 | Baker | D71/1 |
| 1,457,496 | 6/1923 | Butler . | |
| 1,675,957 | 7/1928 | Reeves . | |
| 2,856,867 | 10/1958 | Dasey | 105/369 |
| 3,131,648 | 5/1964 | Seger | 105/369 |
| 3,161,339 | 12/1964 | Weller | 229/14 |
| 3,398,501 | 8/1968 | Aninger | 53/35 |
| 3,554,135 | 1/1971 | Duvall | 105/369 |
| 3,889,743 | 6/1975 | Presnick | 165/46 |
| 4,044,867 | 8/1977 | Fisher | 206/522 |
| 4,093,068 | 6/1978 | Smrt | 206/592 |
| 4,287,250 | 9/1981 | Rudy | 428/166 |
| 4,574,953 | 3/1986 | Garbuzov | 206/522 |
| 4,905,835 | 3/1990 | Pivert et al. | 206/522 |
| 5,135,132 | 8/1992 | Potochnik | 383/3 |
| 5,143,775 | 9/1992 | Olsson et al. | 428/178 |
| 5,180,060 | 1/1993 | Forti et al. | 206/522 |
| 5,184,727 | 2/1993 | Dickie et al. | 206/522 |
| 5,263,587 | 11/1993 | Elkin et al. | 206/522 |
| 5,340,632 | 8/1994 | Chappuis | 206/522 |
| 5,348,157 | 9/1994 | Pozzo | 206/522 |
| 5,351,829 | 10/1994 | Batsford | 206/522 |
| 5,570,788 | 11/1996 | Batsford | 206/522 |

FOREIGN PATENT DOCUMENTS

| | | | |
|---|---|---|---|
| 945465 | 1/1964 | European Pat. Off. . | |
| 395698 | 3/1909 | France | 441/108 |
| 1371316 | 7/1964 | France | 206/522 |
| 2 385 606 | 12/1978 | France | 206/522 |
| 2 565 931 | 6/1984 | France . | |
| 5-201473 | 8/1993 | Japan | 206/522 |
| 848248 | 9/1960 | United Kingdom | 206/522 |
| 91/07974 | 5/1992 | WIPO | 206/522 |

*Primary Examiner*—David T. Fidei
*Attorney, Agent, or Firm*—Ernest V. Linek; Dike, Bronstein, Roberts & Cushman, LLP

[57] ABSTRACT

A packaging component having an inflatable peripheral portion and an interior portion having one or more non-inflatable regions which are shaped to conform to one or more portions of an end or a side of a product so that, when the component is inflated, the component fits firmly and snugly against an end or side of the product. A plurality of such components can be integrally formed in a selected pattern adjacent one another to fit firmly and snugly against the ends or sides of a plurality of products which are corresponding positioned adjacent one another. A pair of such components can also be hingedly connected in an integral fashion so that, when inflated, they can be folded together to enclose a product therebetween.

4 Claims, 2 Drawing Sheets

PACKAGING COMPONENTS

This is a continuation of application Ser. No. 08/367,093 filed on Dec. 30, 1994 now U.S. Pat. No. 5,570,788.

This invention relates generally to product packaging techniques and, more particularly, to uniquely configured inflatable packaging components which provide effective and reliable retention and protection of products during shipment, which components are both reusable and recyclable.

BACKGROUND OF THE INVENTION

Many products when being transported in shipping containers must be firmly retained in such containers often under severe handling conditions, i.e., when the containers are subject to vibration, dropping, or other relatively violent movements thereof, so as to prevent damage to the product. Current packaging techniques for such purposes conventionally utilize solid plastic foam blocks, e.g., of polystyrene or other thermosetting plastic materials, which are specifically shaped to conform to an overall product or at least to selected portions of the product and act as substantially inflexible retainers which relatively completely, or at least partially, surround the product within a shipping container. In some cases, gaps between the product and the container are often loosely filled with separately formed polystyrene plastic pellets, sometimes referred to in the packaging field as plastic "peanuts" or "void fill", or the product may be completely immersed in such pellets within a container.

Such techniques are relatively expensive in that the components used therein are generally discarded once shipment has been made and the product has been removed from the container since such components are not readily reusable and generally cannot be readily recycled. Accordingly, they are often merely placed in landfills where they can be environmentally harmful since they do not degrade as would be desired. Moreover, when relatively large solid plastic foam blocks are used, they are bulky and require relatively large containers for shipment of the products. Furthermore, such large containers take up excessive amounts of storage space.

While it has been suggested that simple rectangular plastic bags, i.e., polyethylene plastic bags inflated with air and permanently sealed, be merely placed at various positions adjacent a product in its container so as to provide a cushion therefor, such inflated polyethylene bags are not effective in retaining the product in a reasonably fixed position in the container and also tend to lose the air therein relatively rapidly so as to become unusable, either during or after transit, and are not readily recyclable. Moreover, such materials are not static dissipative materials, a characteristic which is often desirable in packaging many products, such as electronic products, for example. Further, such inflated bags are relatively easily punctured and often cannot withstand the rough handling which may occur during shipment.

It is desirable to provide a packaging technique which uses packaging components which can effectively retain products in a reasonably tightly fixed position in their shipping containers or cartons, which components can be reused many times before their usefulness ends, and which need not be discarded but rather can be easily recycled for refabrication of such components.

More recent innovative packaging techniques and components have been discussed in my U.S. Pat. No. 5,351,289 issued to me on Oct. 4, 1994, and in my U.S. patent application, Ser. No. 08/227,798, filed by me on Apr. 14, 1994. While the disclosures therein describe unique and desirable packaging components that have many applications in the packaging field, in some applications it is desirable to devise other uniquely different configurations so as to provide less expensive components which are easier to fabricate and which are useful in other applications, particularly where it is desirable to reduce the size of the containers in which the packaging components are used so as to reduce the amount of storage space required therefor.

BRIEF SUMMARY OF THE INVENTION

In accordance with the invention, packaging components are formed as air inflatable and deflatable components having configurations which are uniquely predetermined in accordance with the shape of the products with which they are to be used, which components are easily and readily inflated, via an air pump, or readily deflated, by using an appropriate valve for such purposes. As discussed in my above-referred to patent and patent application, the components are made of a thermoplastic, polyurethane material which can retain its inflated state for an extended period of time and which, when its useful life is over, need not be discarded but can be recycled so that such components can be refabricated. Moreover, such materials can be made static dissipative in nature for use in many applications requiring such characteristic.

In one preferred embodiment, for example, a unique and useful packaging component configuration utilizes a basic unit which includes two integrally formed parts, namely, a first peripheral part which is air inflatable and a second interior part which has one or more non-inflatable regions which latter regions are specifically shaped to conform to one or more portions of an end or side of a product. Further, a plurality of such basic units can be integrally formed in a suitable selected pattern adjacent each other so that they can be positioned to conform to the ends or sides of corresponding adjacent products which are placed in the same container or carton. Further, a pair of such basic units can be hingedly connected so they can be folded toward each other to envelop a product therebetween. If desired, such hinged units can be further arranged to include integrally formed inflatable handle portions to permit easy and safe handling and manual transportation of the product which is enveloped therein.

DESCRIPTION OF THE INVENTION

The invention can be described in more detail with the help of the accompanying drawings wherein FIG. 1 depicts a plan view of a basic packaging unit in accordance with the invention;

Figure 1:
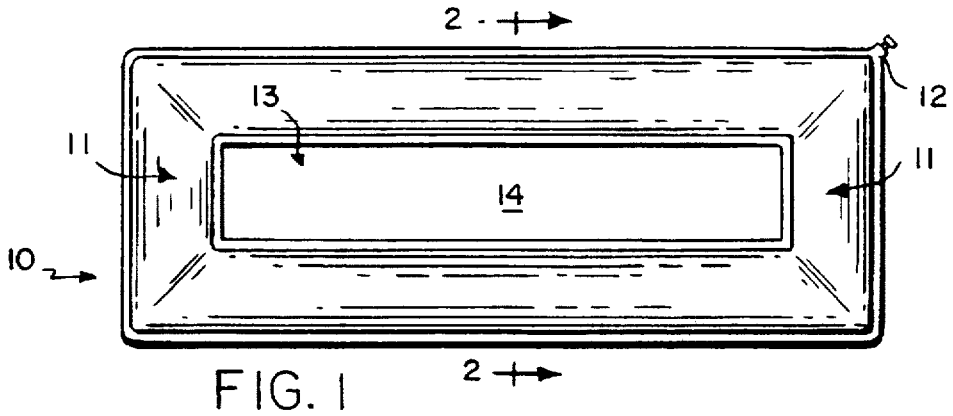
Figure 2:
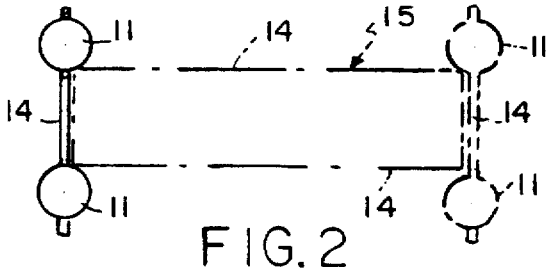
FIG. 2 depicts a diagrammatic side view of the unit of FIG. 1.
Figure 3:
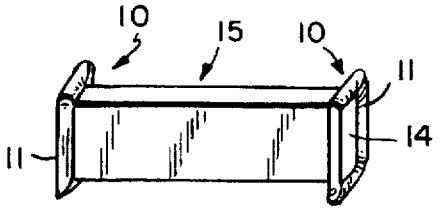
FIG. 3 depicts a perspective view of a pair of such units of FIG. 1 used with a product.

As can be seen in FIGS. 1–3, a basic unit 10 comprises a first peripheral part 11 which is inflatable via a suitable air input/output valve 12 and an interior part 13 which in the particular embodiment shown contains a single non-inflatable region 14. The unit 10 is shown as having a generally rectangular inflatable periphery 11 and a generally rectangular non-inflatable region 14 which latter region has a configuration which during use conforms, for example, to an end of a product 15, for example, as shown at the left end of a product which is depicted in phantom in FIG. 2. Another basic unit 10 of the same type as shown in FIG. 1 can be used on the comparable opposite or right end of the product, the other unit being shown in phantom in FIG. 2 so that when the product is placed in a container, e.g., a corrugated cardboard carton, the product and basic units 10 fit snugly and safely therein. A perspective view of a pair of basic units used at each end of product 15 is depicted in FIG. 3. While the configuration shown is rectangular in shape, it can assume any desired shape to conform to the side or end of a product, e.g., square, circular, diamond-shaped, and the like.

Figure 4:
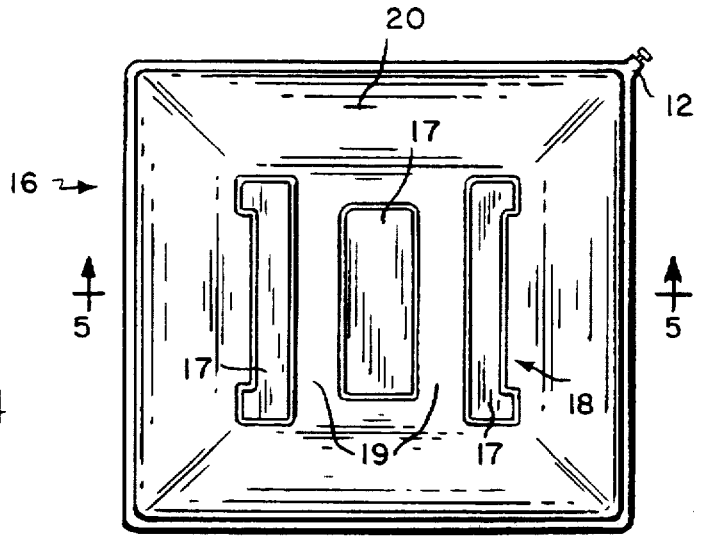
FIG. 4 depicts a plan view of an alternative basic unit of the type shown in FIG. 1.
Figure 5:
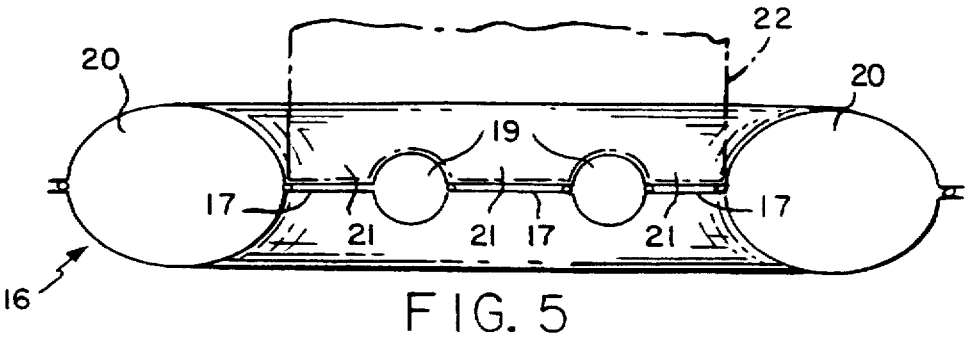
FIG. 5 depicts a diagrammatic view along the line 5—5 of the unit of FIG. 4.

If the product has multiple projecting portions at an end thereof, which portions project generally outwardly therefrom, the interior part of a basic unit utilizes a plurality of separate non-inflatable regions therein corresponding to such portions, the remaining regions therebetween being inflatable. Such an exemplary basic unit 16 is shown in FIGS. 4 and 5 wherein, for example, three appropriately shaped non-inflatable regions 17 are contained within interior part 18 thereof, the remaining interior regions 19 being inflatable. The peripheral region 20 is inflated in the same manner as the peripheral region of FIG. 1. Accordingly, in the example depicted in FIG. 5, the three non-inflatable regions 17 effectively come into contact with three projecting portions 21 at an end of a product 22 (shown in phantom in FIG. 5) so that the unit 16 fits snugly against the end of product 22 when placed within a suitable container.

Figure 6:
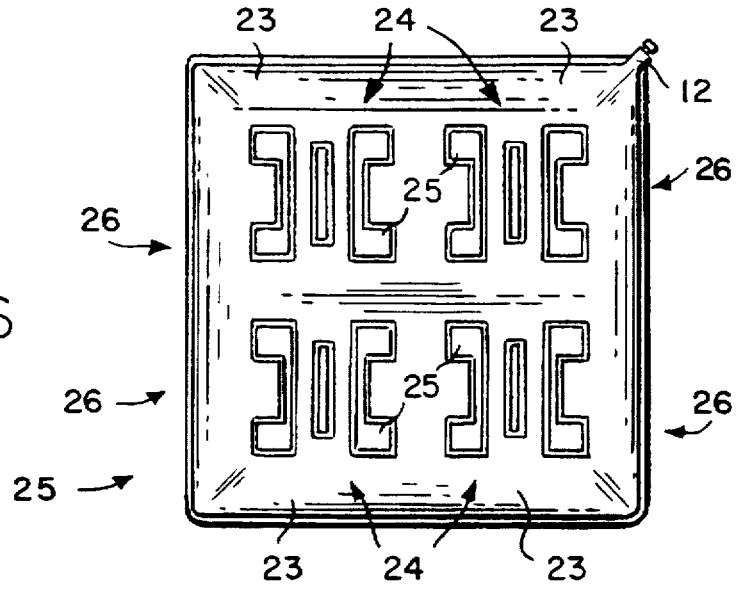
FIG. 6 depicts a plan view of a plurality of integrally formed basic units of the type shown in FIG. 4.

In a further exemplary embodiment of the invention, a plurality of basic packaging components can be effectively integrally formed as an overall packaging system for use with multiple products which are to be placed in the same container or carton. Such a multiple component system 25 is shown, for example, in the plan view in FIG. 6, wherein four basic units 26, each effectively having inflatable peripheries 23 and interior parts 24 with multiple non-inflatable regions 25 therein, are integrally formed in a selected pattern adjacent each other to provide the overall component 25 as depicted. Such component can be used, for example, when four products, e.g., of the type depicted in FIG. 5, are placed adjacent each other within a container.

Figure 7:
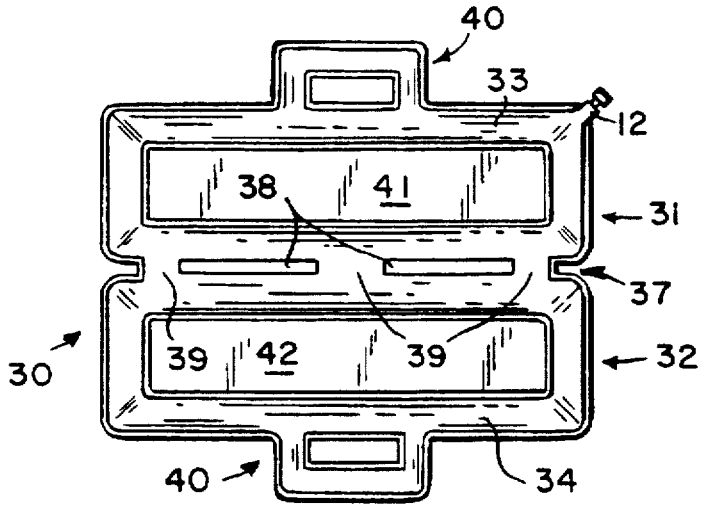
FIG. 7 depicts a plan view of two basic units of the type shown in FIG. 1 which units are hingedly connected.
Figure 8:
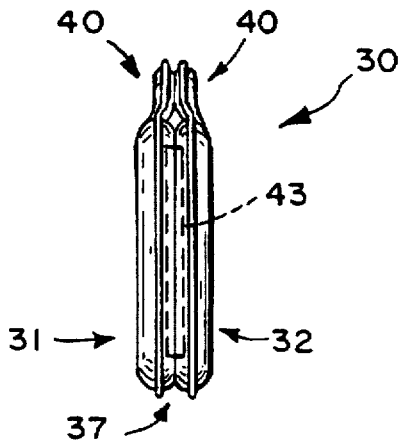
FIG. 8 depicts a side view of the embodiment of FIG. 7 in a folded position.

In a still further embodiment of the invention, two basic units of the type shown in FIG. 1 can be effectively hinged together so that they can be folded so as to envelop or enclose a product for carrying thereof and/or for placement in a container. Thus, as shown in FIGS. 7 and 8, a foldable packaging system 30 having a first basic unit 31 and a second basic unit 32, each having inflatable peripheral regions 33 and 34, respectively, are integrally formed, as depicted, so as to include a hinged portion 37 which in the embodiment shown comprises a pair of non-inflatable hinge regions 38 effectively surrounded by inflatable regions 39. In some cases, a single hinged region will be adequate and in other cases, more than two hinged regions may be required. In the particular embodiment shown, a pair of inflatable handle regions 40 are also integrally formed in the unit and positioned at opposite sides of the packaging system 30. Non-inflated interior regions 41 and 42 of units 31 and 32, respectively, are shaped to conform to the configuration of a product 43 (shown in phantom in FIG. 8), so that, when the system 30 is folded along its hinged region 37, the product 43 can be placed so as to be firmly and snugly retained within the folded system 30 so that it can be readily and safely carried and/or placed in a suitable container or carton for shipment. In some applications, the handle regions 40 can be eliminated and only the basic units 31 and 32 need be used.

While the invention is best described in accordance with the particular preferred embodiments shown and discussed above, modifications thereto within the spirit and scope of the invention may be made by those in the art. Hence, the invention is not to be construed as limited to the particular embodiments depicted, except as deemed by the appended claims.

What is claimed is:

1. A packaging component comprising:

an inflatable continuous peripheral portion defined by a single chamber;

an interior portion shaped as a single plane within said peripheral portion;

said interior portion having a non-inflatable interior region within said single plane;

a valve for permitting said inflatable portion of said component to be inflated and deflated;

wherein said non-inflatable interior region of said interior portion is shaped to effectively conform to a shape of one or more portions of an end or side of a product so that, when said component is inflated, said non-inflatable interior region is plane-shaped, and said component fits firmly and snugly against an end or side of the product.

2. A packaging system consisting of a pair of packaging components, wherein each packaging component comprises:

an inflatable continuous peripheral portion defined by a single chamber;

an interior portion shaped as a single plane within said peripheral portion;

said interior portion having a non-inflatable interior region within said single plane;

a valve for permitting said inflatable portion of said component to be inflated and deflated;

wherein said non-inflatable interior region of said interior portion is shaped to effectively conform to a shape of one or more portions of an end or side of a product so that, when said component is inflated, said non-inflatable interior region is plane-shaped, and said component fits firmly and snugly against an end or side of the product.

3. The packaging component of claim 1, wherein said single plane bisects said peripheral portion.

4. The packaging component of claim 2, wherein said single plane bisects said peripheral portion.

* * * * *